US005925407A

United States Patent [19]

Östman

[11] Patent Number: 5,925,407

[45] Date of Patent: Jul. 20, 1999

[54] METHOD FOR DRYING A SURFACE-TREATED PAPER WEB IN AN AFTER-DRYER OF A PAPER MACHINE AND AFTER-DRYER OF A PAPER MACHINE

[75] Inventor: Kauko Antero Östman, Jyväskylä, Finland

[73] Assignee: Valmet Corporation, Helsinki, Finland

[21] Appl. No.: 08/931,871

[22] Filed: Sep. 17, 1997

Related U.S. Application Data

[XX .
[60] Provisional application No. 60/030,693, Nov. 13, 1996.

[30] Foreign Application Priority Data

Sep. 20, 1996 [FI] Finland ..... 963734

[51] Int. Cl.[6] ..... B05D 1/00

[52] U.S. Cl. ..... 427/209; 427/210; 34/444; 34/117

[58] Field of Search ..... 34/444, 445, 446, 34/454, 455, 456, 116, 117, 119, 122; 427/316, 209, 210; 118/68; 162/207, 208, 135, 136

[56] References Cited

U.S. PATENT DOCUMENTS

| | | | |
|---|---|---|---|
| 3,948,721 | 4/1976 | Winheim | 162/207 |
| 4,702,015 | 10/1987 | Taylor et al. | 34/114 X |
| 5,022,163 | 6/1991 | Ilvespaa et al. | 34/23 |
| 5,172,491 | 12/1992 | Ilvespaa et al. | 34/115 |
| 5,269,074 | 12/1993 | Sims et al. | 34/117 |
| 5,416,980 | 5/1995 | Ilvespaa | 34/117 |
| 5,557,860 | 9/1996 | Kotitschke et al. | 34/455 |
| 5,756,156 | 5/1998 | Elijoki et al. | 34/444 X |

FOREIGN PATENT DOCUMENTS

| | | |
|---|---|---|
| 91900 | 6/1992 | Finland . |
| 944610 | 10/1994 | Finland . |
| 98387 | 8/1996 | Finland . |

*Primary Examiner*—Henry Bennett
*Assistant Examiner*—Steve Gravini
*Attorney, Agent, or Firm*—Steinberg & Raskin, P.C.

[57] ABSTRACT

A method for drying a surface-treated paper web or equivalent in an after-dryer of a paper machine in which the paper web is first finished in a finishing section, e.g., surface-sized or coated, by a finishing device and then dried. In the after-dryer, the paper web is dried in at least one dryer group employing a normal single-wire draw and, in connection with or after the drying, the paper web is treated by at least one device in order to compensate for a tendency of curling of the paper web. The after-dryer is arranged after the finishing device and includes at least one dryer group that applies a normal single-wire draw so as to dry the paper web and one or more devices for compensating for a tendency of curling of the paper web.

25 Claims, 2 Drawing Sheets

METHOD FOR DRYING A SURFACE-TREATED PAPER WEB IN AN AFTER-DRYER OF A PAPER MACHINE AND AFTER-DRYER OF A PAPER MACHINE

This application claims benefit of Provisional Application No. 60,030,693 filed Nov. 13, 1996.

FIELD OF THE INVENTION

The present invention relates to a method for drying a surface-treated paper web or equivalent fibrous material in an after-dryer of a paper machine, in which the paper web is first finished in a finishing section, i.e., surface-sized or coated, by means of a finishing device, and then dried.

The invention also relates to an after-dryer for a paper machine for drying a surface-treated paper web or equivalent which is arranged after a finishing device in which the paper web, is, e.g., surface-sized or coated.

BACKGROUND OF THE INVENTION

As known in the prior art, in multi-cylinder dryers of paper machines, twin-wire draw and/or single-wire draw is/are employed. In groups of drying cylinder employing twin-wire draw, the groups of drying cylinders comprise two wires which press the web, one of which presses the web from above and the other of which presses the web from below, against heated cylinder faces of the drying cylinders. Between the rows of drying cylinders, which are usually horizontal rows, the web has free and unsupported draws, which are susceptible to fluttering, which may cause web breaks, in particular when the web is still relatively moist and therefore has a low strength. For this reason, in recent years, ever increasing use has been made of drying cylinder groups employing single-wire draw, in which each group of drying cylinders includes only one drying wire, on whose support the web runs through the entire group so that the drying wire presses the web on the drying cylinders against the heated cylinder faces, whereas the web remains at the side of the outside curve on the reversing cylinders or rolls arranged between the drying cylinders. Thus, in single-wire draw, the drying cylinders are arranged outside the wire loop, and the reversing cylinders or rolls are arranged inside the wire loop.

In so-called normal groups with single-wire draw, known in the prior art, the heated drying cylinders are placed in an upper row and the reversing cylinders are placed in a lower row below the upper row, which rows are generally horizontal and parallel to one another. On the other hand, in inverted groups with single-wire draw, the reversing cylinders are placed in the upper row and the drying cylinders in the lower row. In the following, when the terms "normal (dryer) group" and "inverted (dryer) group" are used, what is meant is expressly groups with single-wire draw in multi-cylinder dryers, of the type mentioned above.

When a paper web is dried by means of normal groups with single-wire draw from the side of only its bottom face, it is dried asymmetrically and if such asymmetric drying is extended over the entire length of the forward dryer section, the drying takes place so that first the bottom-face side of the paper web is dried and, when the drying makes progress, the drying effect is also extended to the side of the top face of the paper web. Under these circumstances, the dried paper is usually curled and becomes concave, seen from above.

As known in the prior art, the tendency of curling of paper is already affected in connection with the web formation, in particular at the sheet formation stage by means of the selection of the difference in speed between the slice jet and the wire, and by means of other running parameters during production of the paper web. As known from the prior art, for example, in the case of copying paper, by means of unequalsidedness of drying in the after-dryer, a suitable initial curl form is regulated for the sheet in order that the curling of the paper after one-sided or double-sided copying may be optimized. In the case of copying paper, the reactivity of curling, i.e., the extent to which curling occurs per unit of change in moisture content, is affected to a greater extent by means of a multi-layer structure of the paper web, which is produced in connection with the web formation in the wet end of the paper machine.

The most recent technology related to the present invention in high-speed paper machines, in particular in fine-paper machines, has been based on dryer sections in which there is single-wire draw over the major part of the length of the machine and, in view of controlling the tendency of curling of paper, in practice, an inverted group has also been used in order that the drying can be made sufficiently symmetric in the z-direction (the direction of thickness of the web).

In conventional after-dryers in paper machines, in which the web is dried after coating or surface-sizing, a significant problem is presently the swelling of the web arising from the moisture introduced by the coating into the web, which swelling produces "wrinkles" and equivalent problems that deteriorate the runnability in the web. In twin-wire draw, which is traditionally used in an after-dryer, the web flutters between the upper and lower rows, in which connection, web breaks tend to occur and, moreover, on the drying cylinders in the lower row, when the web is wrinkled, the drying wire of the lower row has been readily damaged as a result of the wrinkles. This results in frequent replacements of the lower fabric.

Further, as known from the prior art, problems have also been caused by the lowering of the web strength resulting from the coating, in which connection, long free draws of the web have been quite problematic.

From the prior art, constructions are known for an after-dryer for paper to be coated, in particular for fine paper or equivalent, in which dryer there is first an upper cylinder and a lower cylinder and after this, one group that employs normal single-wire draw, and after the single normal-wire draw group, dryer groups that make use of twin-wire draw. In these applications, it is a problem that, in view of the tendency of curling of paper, the ratio of the upper and lower cylinders is incorrect if the curling is to be regulated efficiently. Further, in conventional after-dryers, it has been necessary to keep the temperature of the first cylinders low because of the adherence of the web and the size/paste to the cylinder.

Groups of the sort mentioned above for finishing of paper to be coated, in particular of fine paper, have been described, among other things, in the current assignee's Finnish Patent Application No. 950434 corresponding to the current assignee's U.S. patent application Ser. Nos. 08/467,780 (now abandoned) and 08/705,059 incorporated by reference herein.

OBJECTS AND SUMMARY OF THE INVENTION

Accordingly, it is an object of the present invention to further develop the paper machine constructions suggested in the above-mentioned Finnish patent application so that the tendency of curling of paper can be controlled more efficiently in the after-dryer of the paper machine.

It is a further object of the invention to provide a construction for an after-dryer which is suitable for use in particular in dryer sections in which it has not been possible or desirable to control the curling of the paper web in the forward dryer section thereof.

Also, it is an object of the invention to create an arrangement to dry a web while the web is still moist after the coating in which there are no long, free draws.

It is a further object of the present invention to provide an after-dryer for a paper machine in which the runnability of the web can be brought to a particularly high level.

Further, it is an additional object of the invention to provide an after-dryer for a paper machine in which so-called ropeless threading can be applied favorably within the entire length of the after-dryer in the machine direction, which for its part contributes to making the constructions simpler and standstills shorter.

In view of achieving the objects stated above and others, in the method in accordance with the invention, the paper web is dried in the after-dryer in one or more dryer groups making use of a normal single-wire draw, and in connection with (within) or after the drying of the web occurring in the normal single-wire draw dryer group or groups, the paper web is treated by means of at least one device in order to compensate for a tendency of curling of the paper web. The web treating step may entail guiding the web past at least one steam box after the web has passed through one of the normal dryer groups, or several normal dryer groups if present, and directing steam from the steam box(es) to interact with the web. In addition to or instead of the interaction of steam with the web to compensate for the curling tendency of the web, the web may be guided through at least one soft-calender nip after the web has passed through one or more of the normal dryer groups. Other curling tendency compensation steps include guiding the web past at least one blower unit arranged in the normal dryer group(s) and directing a medium therefrom to promote evaporation of water from the web through the drying wire and equalize the distribution of moisture in the direction of thickness of the web, and guiding the web past a steam box and/or a moistening device arranged in the normal dryer group(s) and directing a medium therefrom to equalize the distribution of moisture in the direction of thickness of the web and/or to reduce the curling of the web.

The after-dryer in accordance with the invention includes at least one dryer group that applies a normal single-wire draw so as to dry the paper web and at least one device for compensating for a tendency of curling of the paper web.

In the arrangement in accordance with the invention, in which the entire after-dryer is formed as a group with single-wire draw or includes a group with single-wire draw, the web is supported over the entire length of the dryer section, in which case the runnability of the web is very good. Possible curling of the web is compensated for, for example, by means of steam boxes and/or by means of soft-calendering in connection with or after the group(s) with single-wire draw. The web can also be passed to an upper cylinder at the initial end of the after-dryer and directly after the coating, in which case the draw is closed right from the beginning of the after-dryer over the entire length of the after-dryer.

In the following, the invention will be described in more detail with reference to the figures in the accompanying drawings. However, the invention is not strictly confined to the details of the illustrated embodiments.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
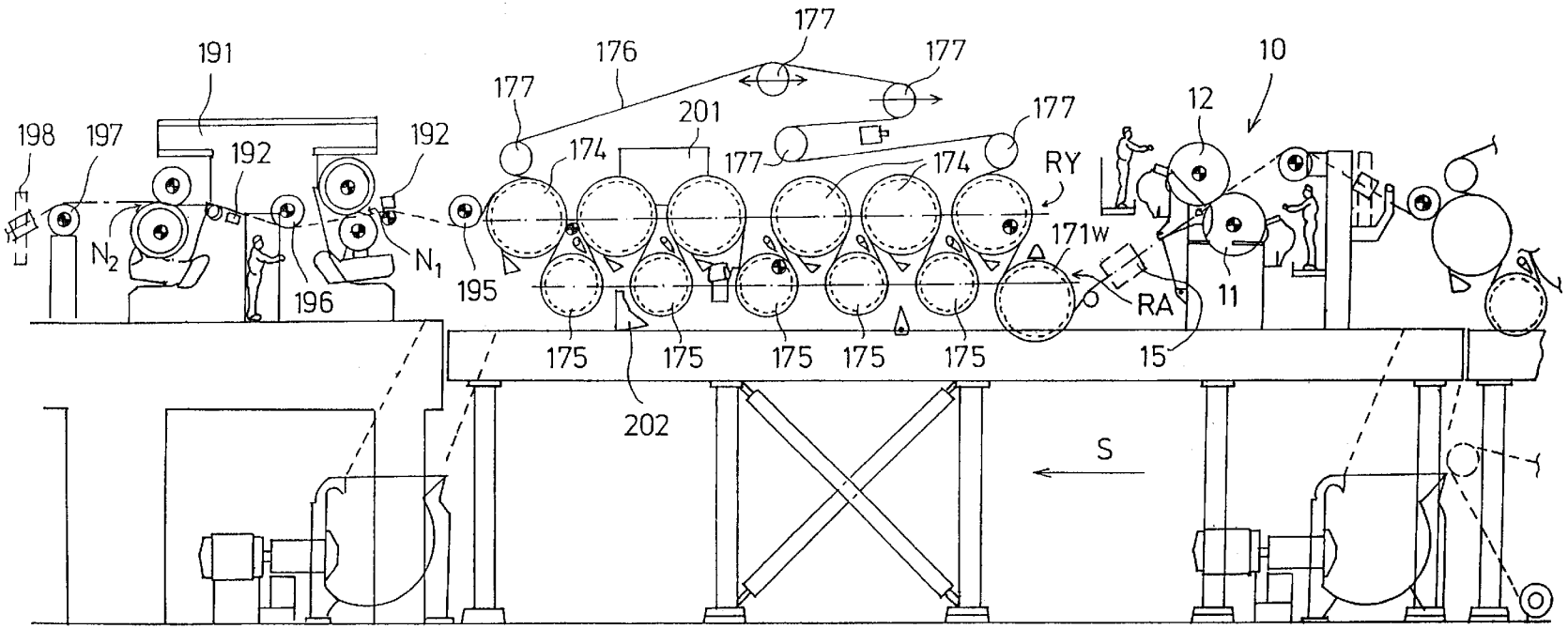
FIG. 1 is a schematic illustration of an exemplifying embodiment of an after-dryer in accordance with the invention which comprises a dryer group that applies a normal single-wire draw.

Referring to the accompanying drawings wherein like reference numerals refer to the same or similar elements, in FIG. 1 a coating device is denoted by reference numeral 10, and the coating device 10 is, for example, a coating device marketed by the current assignee under the tradename SYM-SIZER™, which device comprises two opposed coating rolls 11 and 12, in connection with each of which there are size feed devices so that the paper web W is coated from both sides in a coating nip defined by the rolls 11 and 12. The direction of progress of the paper web W is denoted by reference arrow S. After the coating device 10, the web W is passed over a drying cylinder 171 into the dryer group that applies a normal single-wire draw, in which group, reversing rolls/cylinders 175 are arranged inside a loop of the drying-wire 176 guided by guide rolls 177 and the drying cylinders are denoted by reference numeral 174. Drying cylinder 171 is situated in a lower row alongside the reversing rolls/cylinders 175. In the dryer group, the paper web W to be dried runs from the drying cylinders 174 placed in an upper row RY onto the reversing rolls 175 placed in a lower row RA so that on each drying cylinder 174, the web W is placed against the heated face of the drying cylinder 174, and the web W remains at the side of the outside curve on the wire 176 on the reversing rolls 175 placed in the lower row RA. After the dryer group, the paper web W is passed over a guide roll 195 to a soft calender 191, which comprises two calender nips $N_1$ and $N_2$. In connection with the soft calender, two steam boxes 192 are also placed, and curling of the paper web W is compensated for by means of the soft-calendering vis-a-vis the calender nips $N_1$ and $N_2$ and/or by means of the steam boxes 192. The paper web is passed over a guide roll 197 through a nip device 198 to further processing. Between the calendering nips $N_1$,$N_2$, the web is guided over a guide roll 196 and in operational proximity to one of the steam boxes 192.

In FIG. 1, a pre-drying unit 15 is arranged after the coating device 10 and is operative so that it does not contact the web W, e.g., an infrared dryer or an airborne web dryer or a combination of same, in themselves known from the prior art. In the final portion of the after-dryer, a blower unit 201 is arranged by whose means attempts are made to promote evaporation through the wire, i.e., to equalize the distribution of moisture in the direction of thickness in the paper (the z-direction) that departs from the after-dryer. Further, in the arrangement, there may be a steam box 202 in itself known, of the type described, for example, in Finnish Patent Application No. 906216, or a moistening device 202, which is also in itself known, by means of which the distribution of moisture in the Z-direction of the web is equalized and/or the curling of the web is reduced. All of these additional devices are, of course, not necessarily in use in the same construction.

In relation to curling of the paper web, the current assignee has conducted tests with a newsprint machine, whose dryer section was exclusively provided with single-wire draw and which dryer section was followed by a two-nip soft calender preceded by a steam box. In these reference test run conditions (without calendering and without steam-treatment), it was noticed that the web was curled in the direction of the top face—the edges of a sample of a diameter of 100 mm rose 3 centimeters in the direction of the top face. When the running conditions were kept in the other respects unchanged but the bottom face of the web was steam-treated before the latter soft-calender nip, the curling was reduced significantly to the value 1.2 cm. In a second test, the dryer section was run normally (with calendering), in which case the curling was measured as from about 1.5 cm to about 2 cm, and when the bottom face of the web was steam-treated in the manner mentioned above, the web was no longer curled at all.

Figure 2:
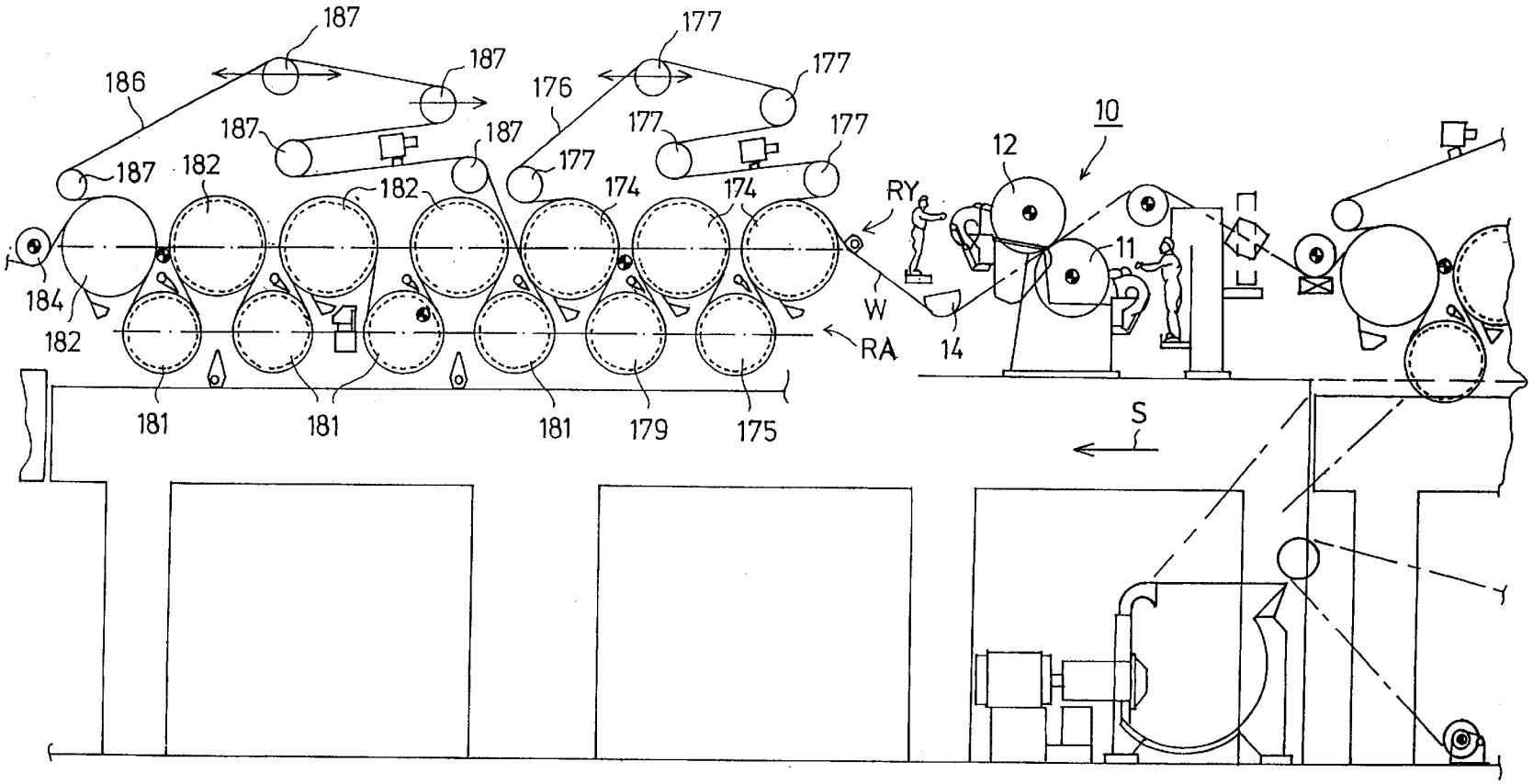
FIG. 2 is a schematic illustration of an arrangement in accordance with the invention in which, after the coating, the web is passed directly onto an upper cylinder in the group with single-wire draw over a reversing blow-box or a reversing roll or equivalent, in which case a closed draw is obtained over the entire length.

With regard to its principal features, the exemplifying embodiment shown in FIG. 2 is similar to the exemplifying embodiment shown in FIG. 1, except that in the embodiment of FIG. 2, a reversing blower device 14 is arranged after the coating device for turning the web so that it is passed directly onto a first drying cylinder 174 in the upper row. After this, there follow two dryer groups that apply a normal single-wire draw, and between these normal single-wire draw groups, there is a closed draw. The parts in the first dryer group that applies a normal single-wire draw are denoted by reference denotations corresponding to FIG. 1, and the drying cylinders in the second dryer group are denoted by reference numeral 182 and the reversing rolls/cylinders are denoted by reference numeral 181. A drying wire 186 in the second dryer group runs guided by guide rolls 187. After the dryer groups, after a guide roll 184, the dried paper web W is passed, in accordance with what is shown in FIG. 1, to the soft calender 191, in whose connection preferably also steam boxes 192 are arranged, in which case it is possible to control the curling of the web W by means of the steam boxes 193 and by regulating the calendering nips N1,N2 of the soft calender 191 in a suitable manner.

In the arrangement in accordance with the invention, as the reversing rolls/cylinders, particularly favorably are used the suction cylinders marketed by the current assignee with the trade mark "VAC-ROLL"™ and provided with no inside suction box, reference being made, with respect to the details of the constructions of such rolls, to the current assignee's Finnish Patent No. 83,680 (corresponding to U.S. Pat. Nos. 5,022,163 and 5,172,491, incorporated by reference herein).

In the following, the patent claims will be given, and the various details of the invention can show variation within the scope of the inventive idea defined in the claims and differ even to a considerable extent from the details stated above by way of example only. As such, the examples provided above are not meant to be exclusive and many other variations of the present invention would be obvious to those skilled in the art, and are contemplated to be within the scope of the appended claims.

I claim:

1. A method for finishing and drying a paper web in a paper machine, comprising the steps of:

surface-sizing or coating each side of the web in a finishing section of the paper machine, passing the web through an after-dryer after the finishing section to dry the surface-sized or coated web, said after-dryer comprising only at least one normal single-wire draw dryer group, each of said at least one normal dryer group including drying cylinders arranged in a first row, reversing cylinders arranged in a second row below said first row, and a drying wire for carrying the web over said drying cylinders and said reversing cylinders, and treating the web within or after said at least one normal dryer group in order to compensate for a tendency of curling of the web.

2. The method of claim 1, wherein the web treating step comprises the steps of:

guiding the web past at least one steam box after the web has passed through said at least one normal dryer group, and directing steam from said at least one steam box to interact with the web.

3. The method of claim 2, wherein the web treating step further comprises the step of:

guiding the web through at least one soft-calender nip after the web has passed through said at least one normal dryer group.

4. The method of claim 1, wherein the web treating step comprises the step of:

guiding the web through at least one soft-calender nip after the web has passed through said at least one normal dryer group.

5. The method of claim 1, wherein the web treating step comprises the steps of:

guiding the web past at least one blower unit arranged in said at least one normal dryer group, and directing a medium from said at least one blower unit to promote evaporation of water from the web through the drying wire and equalize the distribution of moisture in the direction of thickness of the web.

6. The method of claim 1, wherein the web treating step comprises the steps of:

guiding the web past at least one of a steam box and a moistening device arranged in said at least one normal dryer group, and directing a medium from said at least one of said steam box and said moistening device to equalize the distribution of moisture in the direction of thickness of the web and/or to reduce the curling of the web.

7. The method of claim 1, wherein the web is surface-sized or coated by means of at least one finishing device in the finishing section, further comprising the step of:

drying the web between the at least one finishing device and said at least one normal dryer group by means of a contact-free pre-dryer section.

8. The method of claim 1, wherein the web is surface-sized or coated by means of at least one finishing device in the finishing section, further comprising the step of:

guiding the web over a first drying cylinder after the at least one finishing device into said at least one normal dryer group, said web treating step comprising the steps of guiding the web past a first steam box after the web has passed through said at least one normal dryer group to compensate for curling of the web, directing steam from said first steam box to interact with the web, guiding the web through a first calendering nip after the web has run past said first steam box, guiding the web past a second steam box after the web has passed through said first calendering nip, directing steam from said second steam box to interact with the web, and guiding the web through a second calendering nip after the web has run past said second steam box.

9. The method of claim 1, wherein said at least one normal dryer group consists of a single normal dryer group.

10. The method of claim 1, wherein said at least one normal dryer group consists of two successively arranged normal dryer groups.

11. The method of claim 1, wherein the web is surface-sized or coated by means of at least one finishing device in the finishing section, further comprising the step of:

passing the web over a reversing blow device after the at least one finishing device into said at least one normal dryer group.

12. The method of claim 1, wherein the web is surface-sized or coated by means of at least one finishing device in the finishing section, further comprising the steps of:

arranging a first drying cylinder after the at least one finishing device in a position below said first row of drying cylinders in a first one of said at least one normal dryer group in the running direction of the web, and directing the web into contact with said first drying cylinder after the at least one finishing device.

13. The method of claim 1, wherein the web is surface-sized or coated by means of at least one finishing device in the finishing section, further comprising the step of:

directing the web in a closed draw after the at least one finishing device into contact with a first one of said drying cylinders in said first row of a first one of said at least one normal dryer group in the running direction of the web.

14. The method of claim 1, wherein said at least one normal dryer group comprises a plurality of normal dryer groups, further comprising the step of:

passing the web in a closed draw between adjacent ones of said normal dryer groups.

15. A paper machine, comprising a finishing section in which each side of a paper web is surface-sized or coated, and an after-dryer arranged after the finishing section for drying the surface-sized or coated web, said after-dryer comprising only at least one normal single-wire draw dryer group, each of said at least one normal dryer group including drying cylinders arranged in a first row, reversing cylinders arranged in a second row below said first row, and a drying wire for carrying the web over said drying cylinders and said reversing cylinders, and curling tendency compensation means arranged within or after said at least one normal dryer group for compensating for a tendency of curling of the web.

16. The paper machine of claim 15, wherein said curling tendency compensation means comprise at least one of a soft calender and a steam box arranged after said at least one normal dryer group.

17. The paper machine of claim 15, further comprising a blower unit arranged in one of said at least one normal dryer group to promote evaporation of water from the web taking place through the respective drying wire and to equalize a moisture distribution in a direction of thickness in the web.

18. The paper machine of claim 15, wherein said curling tendency compensation means comprise at least one of a steam box and a moistening device arranged in one of said at least one normal dryer group to equalize a moisture distribution in a direction of thickness in the web and thus reduce the curling of the paper web.

19. The paper machine of claim 15, further comprising a pre-dryer arranged between the finishing section and said at least one normal dryer group, said pre-dryer being arranged for contact-free drying of the web.

20. The paper machine of claim 15, wherein said at least one normal dryer group consists of a single normal dryer group.

21. The paper machine of claim 15, wherein said at least one normal dryer group consists of two successively arranged normal dryer groups.

22. The paper machine of claim 15, wherein said curling tendency compensation means comprise two steam boxes arranged after said at least one normal dryer group.

23. The paper machine of claim 22, wherein said curling tendency compensation means further comprise a soft-calender including first and second calendering nip, a first one of said two steam boxes being arranged between said at least one normal dryer group and said first calendering nip and a second one of said steam boxes being arranged between said first and second calendering nips.

24. The paper machine of claim 15, further comprising a reversing blow device arranged between the finishing section and a first one of said at least one normal dryer group in the running direction of the web.

25. The paper machine of claim 15, wherein said at least one normal dryer group comprises a plurality of normal dryer groups, the web being passed between adjacent ones of said normal dryer groups in a closed draw.

* * * * *